United States Patent [19]

DiLorenzo

[11] 4,317,213

[45] Feb. 23, 1982

[54] TELEVISION RECEPTION INTERFERING APPARATUS

[76] Inventor: Mark DiLorenzo, 5812 W. Moreland Cir., Westminster, Calif. 92683

[21] Appl. No.: 148,113

[22] Filed: May 9, 1980

[51] Int. Cl.[3] ..... H04K 3/00

[52] U.S. Cl. ..... 455/1; 455/231; 455/289

[58] Field of Search ..... 455/1, 171, 172, 181, 455/231, 289; 358/114, 118

[56] References Cited

U.S. PATENT DOCUMENTS

| | | | |
|---|---|---|---|
| 2,755,424 | 7/1956 | Papitto | 455/172 |
| 3,936,752 | 2/1976 | Sasabe et al. | 455/181 |
| 4,039,954 | 8/1977 | den Toonder | 455/1 |
| 4,081,753 | 3/1978 | Miller | 455/181 |
| 4,081,754 | 3/1978 | Jackson | 455/181 |
| 4,232,396 | 11/1980 | Grimes | 358/114 |

*Primary Examiner*—Jin F. Ng

*Attorney, Agent, or Firm*—Townsend and Townsend

[57] ABSTRACT

Apparatus for use with a television receiver for selectively inhibiting reception of television broadcast signals. The apparatus includes a number of signal generating circuits, each respectively set to generate an electrical signal substantially equal to the carrier frequency of a corresponding television broadcast signal, and timer capable of being preset to activate and deactivate selected oscillators on a timed basis. The signal generating circuits are coupled to the antenna input leads of the television receiver so that when activated the electrical signals produced thereby cause sufficient interference with the corresponding incoming television broadcast signal to effectively block reception.

9 Claims, 7 Drawing Figures

TELEVISION RECEPTION INTERFERING APPARATUS

This invention relates to apparatus for selectively hindering reception of regularly programmed television broadcasts. More particularly, the invention relates to apparatus that allows for preselected interfering with one or more television channel broadcasts on a timed basis.

BACKGROUND OF THE INVENTION

At present there exists at least some controversy about the content of certain television programs being broadcast. Many feel, perhaps with some justification, that television programs are broadcast which are objectionable for viewing, particularly by small children. Accordingly, parents often try to screen the content of television broadcasts to locate those programs which they may feel unsuitable for viewing by their children and yet allow them to watch suitable programs being aired on competing channels at the same time.

However, it is often inconvenient to continuously monitor the programs being aired for viewing, particularly in situations where children have access to a television receiver out of the presence of the parent. In order to inhibit a child from watching a program considered objectional by the parent, the television receiver can be temporarily removed or otherwise disabled. However, this solution is altogether too satisfying for the reason that there may be a program the child desires to watch, and which the parent does not consider objectionable, being broadcast during the same time period.

There is presently available apparatus for limiting reception of television broadcast signals. However, the television receiver must be modified to accept such apparatus. For example, in one case the channel selector knob of the television receiver must be changed in order to accept the reception limiting apparatus. In another case, the tuner unit of the television receiver must be constructed in an appropriate manner. Examples of such television broadcast reception inhibiting apparatus can be seen in U.S. Pat. Nos. 3,569,839 and 4,158,816.

SUMMARY OF THE INVENTION

The present invention provides apparatus that can easily be attached to a television receiver for selectively inhibiting and interfering with reception of television broadcast signals with no modification of the receiver itself. The apparatus is simple to use and inexpensive to construct.

According to the present invention, therefore, there is provided signal generating circuitry, a timer preset to activate and deactivate the signal generating circuitry on a real time basis, and a signal-carrying line attachable to a television receiver. The signal generating circuit generates an electrical signal of a frequency substantial equal to the carrier frequency of a television broadcast channel carrying material considered objectionable by the user. The output of the signal generator is coupled to the antenna terminal inputs of the television receiver with which the invention is used. When activated, the signal generating circuitry provides an electrical signal that interferes with the incoming television broadcast signal to effectively block reception and display of the broadcast material.

In the disclosed embodiment, the signal generator circuit comprises a number of transistorized oscillators, each set to oscillate at the frequency of the television broadcast carrier signal of the particular channel with which the oscillator is associated. Each oscillator, when activated, will generate a signal that is coupled to the antenna terminals of the receiver with which the invention is used. The generated signal acts to mask or otherwise impede reception by the receiver of television broadcast signals.

A microprocessor-based timer functions to selectively activate and deactivate each oscillator on a real time basis. The timer includes a keyboad for allowing one to make time entries designating the day and time of day a particular oscillator is to be activated and deactivated, entry logic for formatting the time entries made at the keyboard, a microprocessor and associated memory circuits, and an output register that holds an activating signal supplied by the microprocessor and couples the signal to the respective oscillators.

A number advantages are obtained by the present invention. First, the invention provides for interfering with and inhibiting reception of selected television broadcast signals on a timed basis. For example, a user may determine that on Tuesday between the hours of 7 pm and 9 pm a particular television channel will broadcast material considered to be objectionable. Accordingly, the user can preset the timer to activate the associated oscillator only for the desired time period each Tuesday. Reception of broadcast material remains uninterrupted at all other times.

A further advantage of the invention is that reception is inhibited of only preselected channels, leaving other channels free to be received and viewed.

An additional advantage of this invention obtains from the fact that the advantages identified above are incorporated in an integral unit that can be adapted to be used with a television receiver without having to otherwise modify or design the receiver with the invention in mind.

Other objects features and advantages will become more readily understood from the following detailed description taken in conjunction with the appended claims and attached drawings.

DETAILED DESCRIPTION OF THE INVENTION

General

Figure 1:
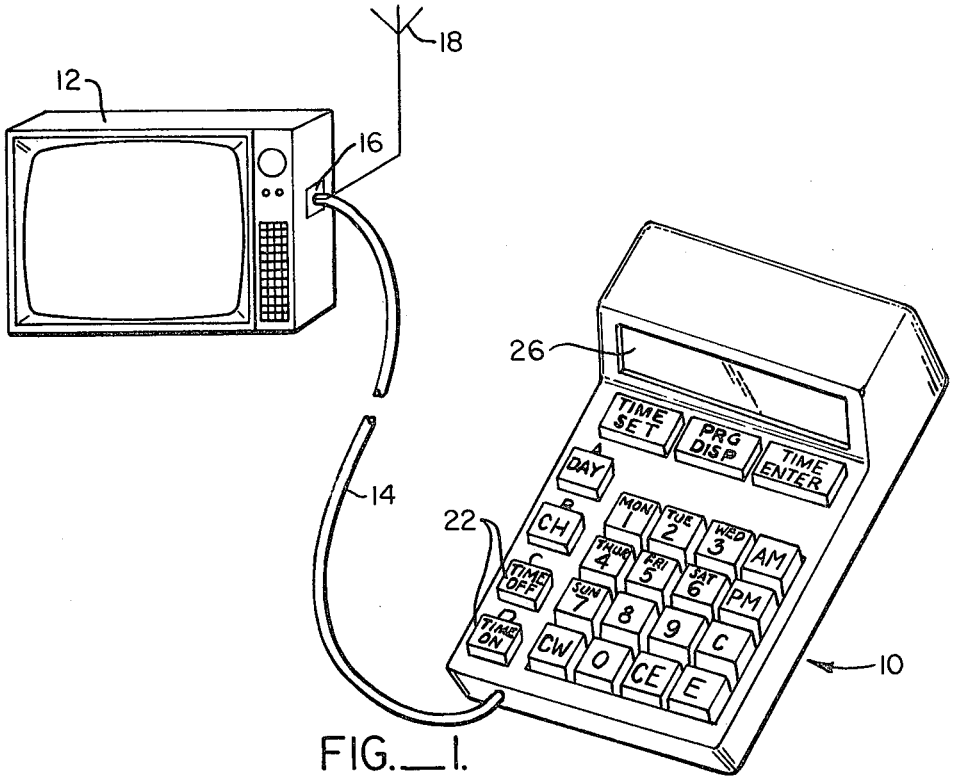
FIG. 1 is an illustration of the present invention used in conjunction with a conventional television receiver.

Referring to FIG. 1 there is illustrated the television reception interfering apparatus, generally designated with the reference numberal 10, connected to a conventional television receiver 12 via a signal line 14 that attaches to the antenna input terminals 16. An antenna 18 also is coupled to the antenna terminals 16 of the receiver 12. It may be seen in FIG. 1 that according to the present invention there may be readily constructed a television reception interfering apparatus 10 that may be of a size such that it may readily be held by a human hand (not shown).

The reception interfering apparatus 10 is provided with a keyboard panel 20 which holds a plurality of finger depressible keys 22, used to effect presetting the timer portion (discussed below) of the reception interfering apparatus 10. Adjacent the keyboard panel is a display 26 which may be constructed from light emitting diodes, liquid crystal displays or other display apparatus well known to those in the art. The display 26 functions to provide the user with a visual indication of the entries used to preset the timer (discussed below) via the finger depressible keys 22.

Figure 2:
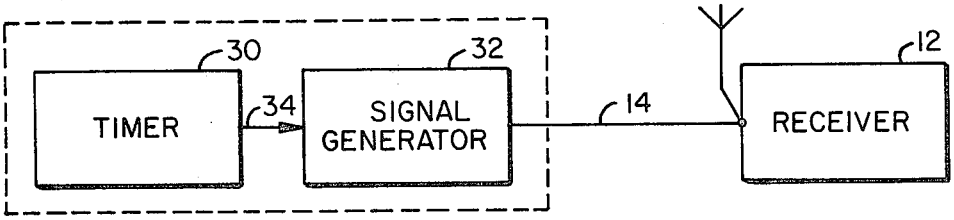
FIG. 2 is a simplified block diagram of the invention illustrated in FIG. 1.

In its most simplified form, the invention illustrated in FIG. 2 includes a presettable timer 30 that is operably connected to a signal generating circuit 32 which, in turn, is coupled to the receiver 12 via the signal line 14. The timer 30 functions to selectively provide an activation signal is communicated to the signal generator 32 on the signal line 34. As will be seen, the timer 30 is structured so that it can be preset to generate the activation signal at a first predetermined time. The activation signal remains until a second predetermined time (also presettable), whereupon the timer terminates generation of the activation signal.

While the activation signal is present, the signal generator 32 will provide an interference signal of a frequency substantially equal to a television broadcast carrier frequency. The interference signal is applied directly to the antenna terminals 16 of the television receiver 12, being conducted thereto by the signal line 14. The interference signal generated by the signal generator 32 is of a magnitude (approximately 10 dbmv) sufficient to interfere with and otherwise block reception of the television broadcast signal by the receiver 12.

Signal Generator

Figure 3:
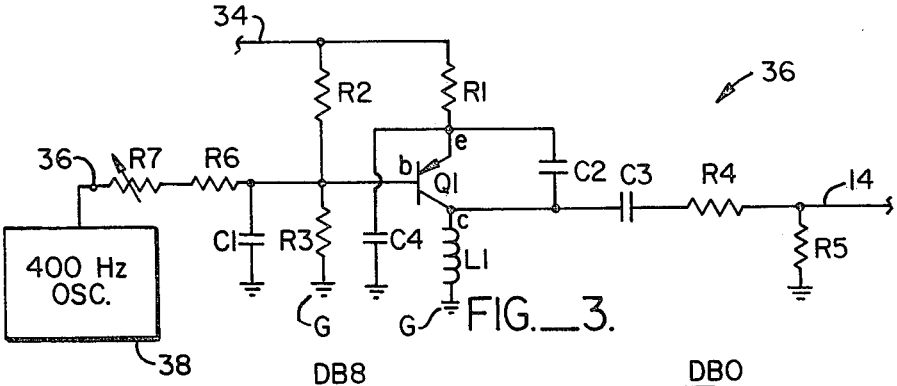
FIG. 3 is a schematic diagram illustrating the structure of one of an oscillator circuit used in the present invention as the signal generator.

Turning now to FIG. 3, the signal generator 32 is illustrated in the form of a high frequency oscillator circuit 36 which includes a PNP transistor Q1. The transistor Q1 has its emitter lead (e) coupled to signal line 34 via resistor R1 and its collector lead (c) coupled to a ground G via an inductor L1. A biasing network comprising series resistors R2 and R3 connect the signal line 34 to the ground G and provide a bias voltage for the transistor Q1 when the base lead (b) is connected to the interconnecting point between the two resistors R2, R3. The values of resistors R2 and R3, as well as R1, are selected to place the transistor in a conducting, but non-saturating, state when approximately 5 volts D.C. are applied to the signal line 34. The capacitor C1 is a bypass capacitor to keep the base lead (b) of the transistor Q1 at essentially a D.C. voltage during operation (i.e., oscillation) and to aid stability. A timing capacitor C2 couples the emitter lead (e) to the collector lead (c) of the transistor Q1.

The signal generated by the oscillator circuit 36 is coupled to the signal line 14 by a capacitor C3 and isolation resistor R4. Resistor R5 is used to terminate the output of the oscillator circuit 36 in a load impedance and to help eliminate drastic changes in the load, as seen by the circuit, when an external load is connected. In addition, a stabilizing capacitor C4 is added between the emitter lead (e) and the ground G to protect the oscillator circuit 36 from being susceptible to stray capacitance effects and to aid in stability of performance.

If desired, the signal generated by the oscillator circuit 36 can be modulated to provide additional interference with the incoming television broadcast signal. Accordingly, there can be added to the oscillator circuit a series configuration consisting of an isolation resistor R6 and a variable resistor R7. One terminal of the isolation resistor R6 is electrically connected to the base lead (b) of the transistor Q1, the other lead being connected to the variable resistor R7. The isolation resistor functions to isolate the oscillator circuit 36 from other similarly constructed oscillator circuits when more than one such circuit is used in the parallel configuration illustrated in FIG. 4 (i.e., OSC1–OSC12).

The unconnected lead of the variable resistor R7 forms a modulating input terminal 36 that receives a 400 Hz signal from a 400 Hz oscillator 38, which may be implemented by any one of the many integrated oscillator circuits commercially available today. The variable resistor R7 allows regulation of the amplitude of the 400 Hz signal applied to the base lead (b) of the transistor Q1 to provide optimal modulation of the signal generated by the oscillator circuit 36.

The oscillator circuit 36 is called into operation by an activation signal of approximately 5 volts D.C. that is provided by the timer 30 (FIG. 2) and conducted to the oscillator circuit 36 by the signal line 34. The series resistors R1 and R2 form a voltage divider network to supply bias voltage to the base lead (b) of the transistor Q1 when the 5 volt D.C. activation signal is present on signal line 34. Properly biased, the transistor Q1 will generate a signal of a frequency that is determined primarily by the timing capacitor C2, stabilizing capacitor C4, and the conductor L1. The signal generated by the oscillator circuit 36 becomes the interference signal. The magnitude of the interference signal is determined by the dropping resistor R1. A signal magnitude of approximately 10 dbmv at signal line 14 will be sufficient to effectively impede reception of a television broadcast signal having a carrier frequency substantially the same as the frequency of the signal generated by the oscillator 36, when the latter is coupled to the antenna input terminals of a television receiver.

If the 400 Hz oscillator is used to modulate the blocking signal, the reception and display by receiver 12 (FIG. 1) of a television broadcast signal is further impeded. Modulating the blocking signal with the 400 Hz signal will produce a series of horizontal lines on the display screen of the receiver 12 as well as impress a 400 cycle tone on the audio produced by the receiver 12.

Thus, in its simplest form, the present invention would utilize the timer/signal generator combination 30, 32 depicted in FIG. 2 for each broadcast channel carrying program material considered objectionable by the user. In operation, the timer 30 is preset to generate an activation voltage that is communicated to the signal generator 32 at a first predetermined time and for a predetermined (preset-table) period. During the presence of the activation voltage, the signal generator 32 produces a signal of a set frequency and of sufficient magnitude to effectively interfere with the incoming television broadcast material. At a second predetermined time the timer 30 ceases to generate the activation voltage which, in turn, deactivated the signal generator 32 and removes the interfering signal.

Timer

It should be evident to those skilled in the art that the timer 30 can take a variety of forms. For example, timer 30 may be implemented by a conventional 24-hour lamp and appliance timer manufactured by various companies. The timer, which would be plugged into the household 120 VAC receptacle, could operate a relay (not shown) that is used to selectively communicate a D.C. operating voltage to the signal generator 32. However, use of this type timer would require one for each television station that broadcast material considered to be objectionable by the user. Accordingly, for ease of operation, it is preferred that timer operations for each separate signal generator 32 be incorporated in a single unitary unit. Illustrated in FIG. 4, therefore, a microprocessor controlled timer is ideally suited for use in the present invention. It will be evident, however, to those skilled in the art that microprocessor based timers are well known (see, for example, U.S. Pat. Nos. 3,999,050 and 4,072,825). Thus, the following discussion taken in conjunction with FIG. 4, is presented herein for illustrative purposes only.

Figure 4:
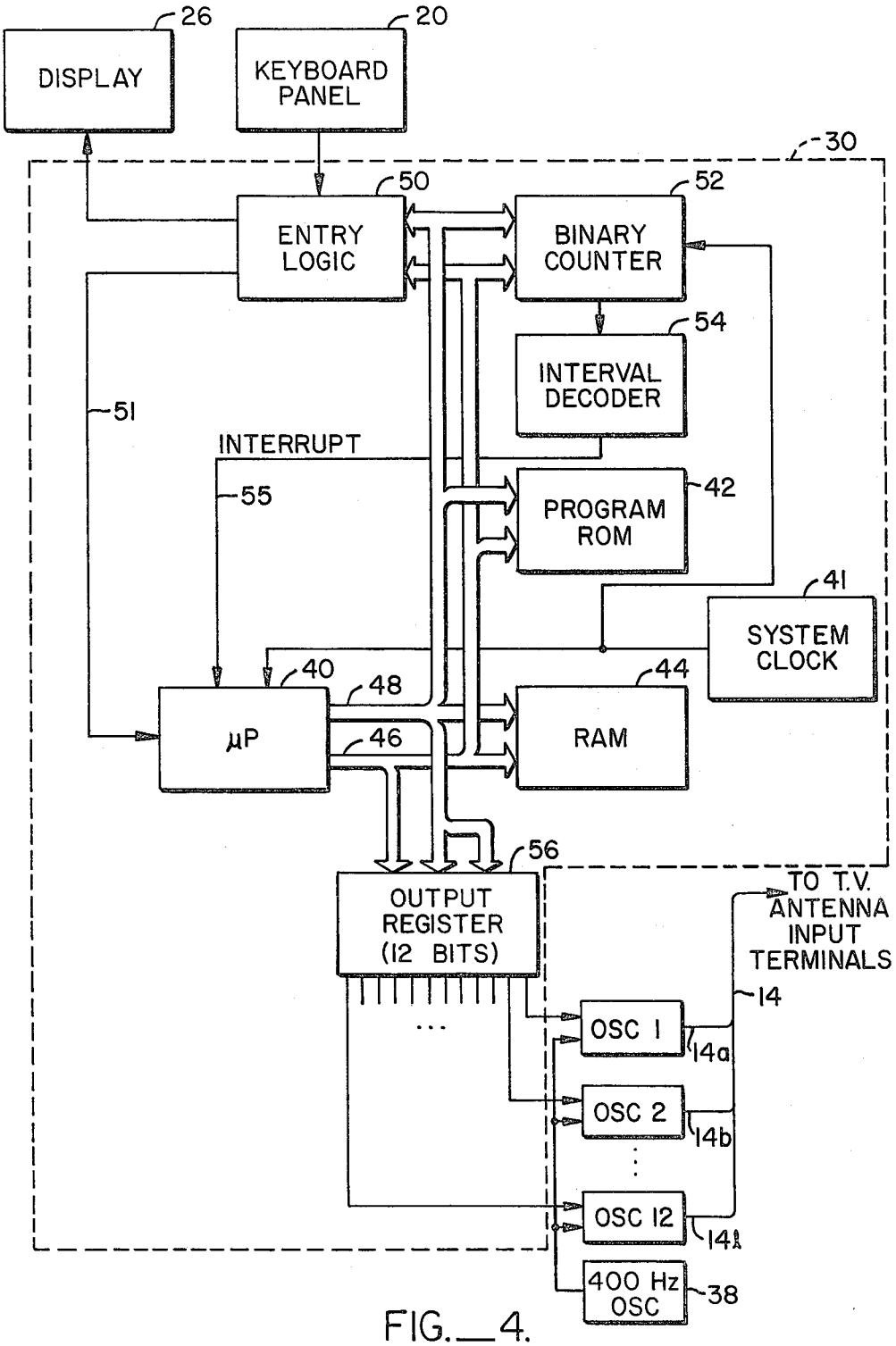
FIG. 4 is a detailed block diagram of the present invention illustrating in particular the microprocessor controlled timer unit.

Turning now to FIG. 4, timer 30 is illustrated as microprocessor controlled unit that provides activation signals for a signal generator 32, comprising twelve individual oscillator circuits (OSC1–OSC12), each constructed essentially as described above and illustrated in FIG. 3. Each oscillator circuit OSC1–OSC12 is constructed to generate an interference signal having a frequency substantially equal to the carrier frequency of the television channel with which the particular oscillator is associated. The respective output lines **14*a*–14*l* of oscillator circuits OSC1–OSC12 are coupled in parallel to the signal line 14 to conduct the interference signals generated by each to the antenna input terminal 16 of the television receiver 12 (FIG. 1**).

The timer 30 itself is shown as comprising a microprocessor 40 that receives timing signals from a system clock 41 and operates in response to a flow of instructions that are provided by a program read-only-memory (ROM) 42. A random-access-memory (RAM) 44 provides the microprocessor 40 with a temporary storage facility. The microprocessor 40, program ROM 42 and RAM 44 are interconnected by a data bus 46 and an address bus 48 to conduct data and addresses therebetween in well-known fashion. The data and address buses 46, 48 also connect the microprocessor to entry logic 50, which receives the preset information from the keyboard panel 20.

A presettable binary counter 52 receives clock pulses from a system clock 41 to provide a real-time count for determining when to activate or deactivate selected ones of the oscillator circuits OSC1–OSC12. An interval decoder 54 monitors the count produced by the binary counter 52 to produce an INTERRUPT signal at predetermined times which is conducted to the microprocessor by signal line 55. Preset information is communicated to the binary counter 52 via the data bus 46 under control of the microprocessor 40.

Also connected to the data and address buses 46, 48, respectively, is a 12-stage output register 56. Each stage of the output register 56 is associated with a corresponding one of the oscillator circuits OSC1–OSC12; and output lines **34*a*–34*l* interconnect the individual stages of the output register 56 and the associated oscillator circuits OSC1–OSC12. When any stage of the output register 56 is set to a binary "1" and activation signal of sufficient voltage to cause the associated oscillator circuit to operate is conducted on the signal line interconnecting the output register 56 stage and the oscillator circuit. Alternately, setting any stage of the output register 56** to a binary "0" will cause the associated oscillator circuit to cease operation.

The information used by the timer 30 to activate or deactivate selected ones of the oscillator circuits OSC-1–OSC12 at a predetermined times is entered by the user via keyboard panel 20 and the finger depressible switches 22 in a manner described below. Each entry on the keyboard panel 20 is communicated to the entry logic 50 and temporarily stored. At the same time, an ENTRY signal is communicated to the microprocessor 40 on the signal line 51 from the entry logic 50, notifying the microprocessor that an input word resides in the entry logic 50. The microprocessor 40 will then address the entry logic 50 and read via the data bus 46 the information stored therein.

Timer Operation

Figure 5:
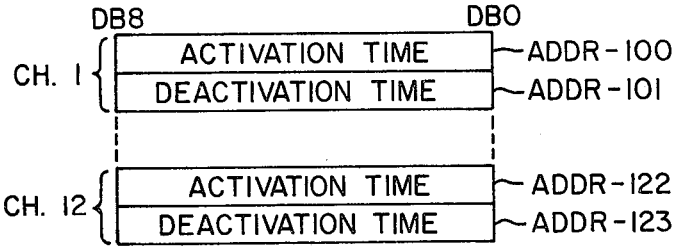
FIG. 5 is an illustration of the binary word format of activation and deactivation times stored in the memory circuits of FIG. 3.

The predetermined times at which the oscillator circuits OSC1–OSC12 are activated and deactivated are stored by the microprocessor 40 in a sequential list of data words in the RAM 44. Each data word is 16 bits in length and there is a pair of such data words for each television channel whose reception is to be blocked by the invention. FIG. 5 illustrates the list of 8 bit data words used to activate or deactivate predetermined ones of the oscillator circuits OSC1–OSC12.

The activation and deactivation times for the individual oscillators are preset in the following manner: first, the finger depressable button 22 marked DAY is depressed, indicating to the microprocessor 40 and entry logic 50 that a preset time is to be received. Next, one of the finger depressable keys bearing the notation MON, TUE, etc. is depressed for the particular day. This information is temporarily stored in the entry logic 50 to later be combined with further information entered. The particular channel to be impeded is entered by depressing the finger depressable key 22 bearing the mark CH, followed by the channel number (via finger depressable keys 22 marked "1," "2," . . . or "9"). Now that the channel to be impeded, and the day that the channel will be impeded, the on and off times are entered. The finger depressable key 22 marked TIME OFF is depressed followed by entering the time of day (AM or PM). The deactivation time is entered by depressing the TIME ON marked finger depressable key 22 followed by entry of the deactivation time via the numbered and AM or PM finger depressable keys 22. When the last entry is made, the entry logic 50 will combine the DAY entry with the TIME OFF and TIME ON entries to produce the activation and deactivation binary data words that are to be transferred to and stored in memory locations contained in the RAM 44. The channel (CH) entry forms the address of the memory location in RAM 44 at which the activation time is to be stored. The entry logic 50 notifies the microprocessor 40 via a signal conducted on signal line 51 that the information is ready for transfer and the microprocessor will read the activation time and address, transfer it to the RAM 44, and again read the deactivation time from the entry logic 50 which also is stored in the RAM 44.

Figure 6:
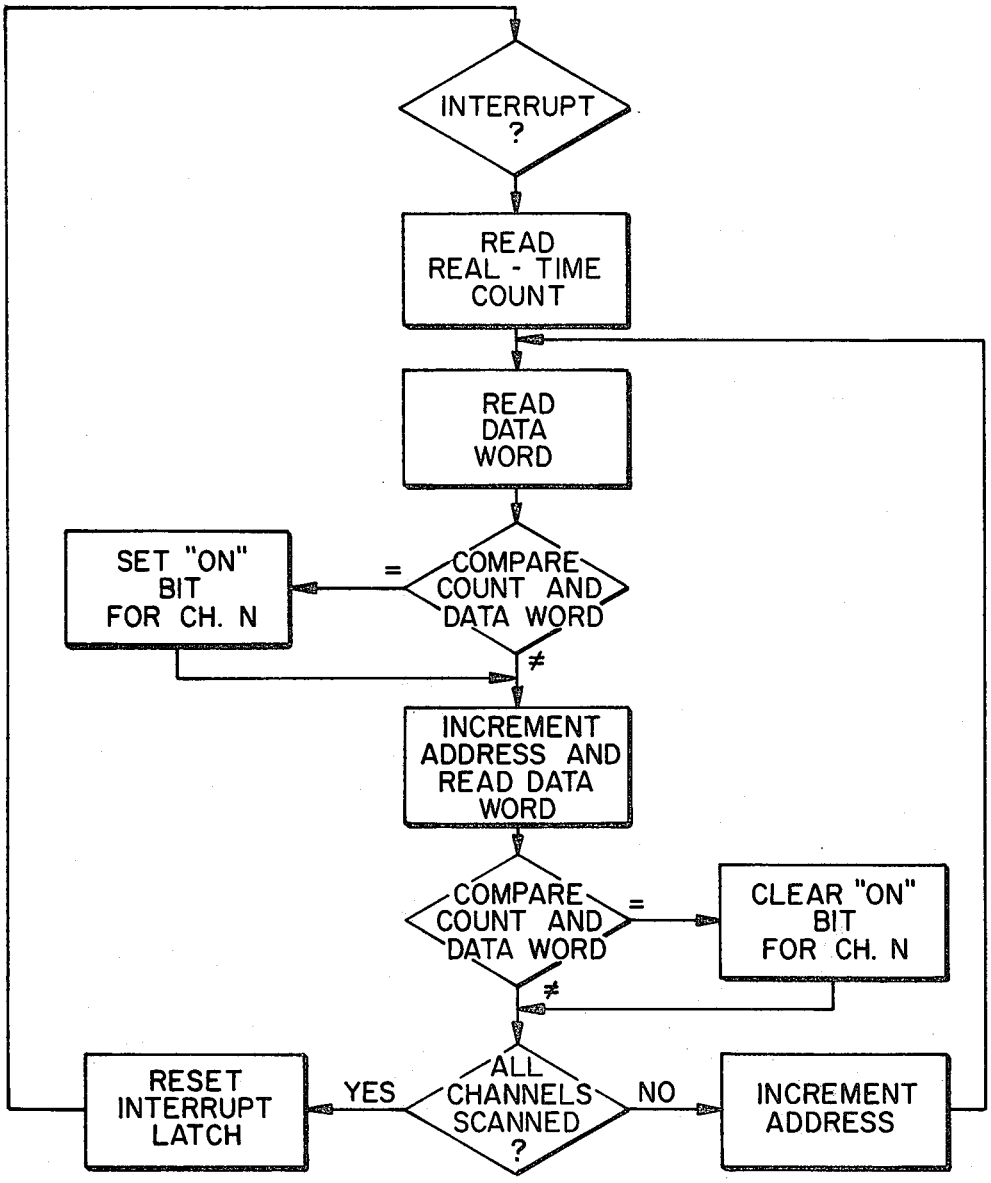
FIG. 6 is a flow chart illustrating operation of the timer unit to activate or deactivate selected oscillator circuits.

Referring now to FIG. 6, there is shown a flow chart which illustrates the operation of the microprocessor-based timer 30 of FIG. 4 to activate and deactivate ones of the oscillator circuits OSC1–OSC12. Assume for the purposes of the present discussion that the activation and deactivation times have been entered and stored in the RAM 44 as described above and illustrated in FIG. 5. The binary counter 52, which receives clock pulses generated by the system clock 41, provides counts of real time of day (TOD) in units of minutes and hours on a week-by-week cyclic basis. The count produced by the binary counter 52 is monitored for each hour interval by the interval decoder 54. That is, each hour on the hour, the interval decoder 54 will issue an INTERRUPT signal that signifies each hour interval (i.e., 10 o'clock, 11 o'clock, etc.).

The INTERRUPT signal is conducted by the signal line 55 to the microprocessor 40. The microprocessor 40 then reads the (real time) count of the binary counter 52, which is stored in a scratch pad memory (not shown) typically contained within the microprocessor 40. The microprocessor 40 then begins a scan of the activation and deactivation data words stored in the RAM 44. As indicated in FIG. 6, this sequential scan proceeds by first reading the data word stored at the memory location ADDR-100 and comparing it to the stored (real time) count obtained from the binary counter 52. If coincidence is obtained, the microprocessor 40 will "set" the stage of the 12-stage counter 56 associated with the particular oscillator to be activated.

After the compare is made, the microprocessor reads the next (deactivation time) data word and compares it with the real time count to determine if coincidence exists. If so, the particular stage of the 12-stage counter 56 associated with the word will be reset. The address is again incremented, and a check made to determine whether or not all data words have been accessed. If not, the microprocessor loops back to compare activation and deactivation time data words to the real time count until all data words have been accessed. After the data words have all been accessed, the microprocessor will reset the interval latch to clear the INTERRUPT signal and returns to a idle state until called upon again by the INTERRUPT signal or the entry of preset information by a user.

The particular stages of the output register 56 that have been "set" to a logic "1" will provide the oscillator OSC1–OSC12 associated therewith, a voltage level sufficient to cause it to be activated. The particular oscillator OSC1–OSC12 will then generate a signal of a predetermined frequency (substantially identical to the television broadcast carrier frequency of the channel with which the oscillator is associated) which is conducted via the signal line 14 to the TV antenna input terminals.

Figure 7:
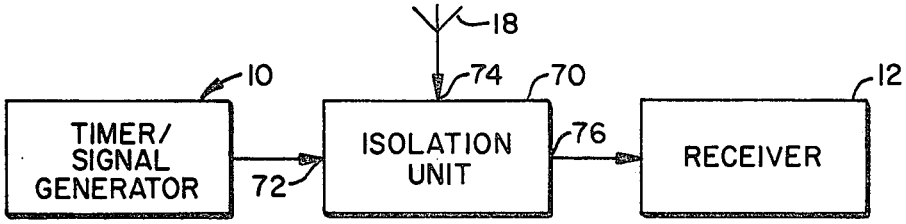
FIG. 7 is a block diagram illustrating use of the invention with an isolation unit to prevent radiation of the oscillator generated signals on the television antenna.

It may be desired, in order to minimize radiating the interference signal produced by the oscillator circuits OSC1–OSC12 from the TV antenna 18, to provide an isolator network 70 for use with the present invention. Such isolator networks are well known in the art and will not be described in detail here except to point out that the isolator unit 70 (FIG. 7) would be provided with signal inputs 72 and 74 to receive the signals from the television reception blocking apparatus 10 and the television antenna 18, respectively. These signal inputs 72 and 74 provide a low impedance path from the particular input to the output 76 of the isolator unit 40 but provide a very high impedance from, for example, the input 72 to the input 74. These signals provided by the television reception blocking unit 10 and the television antenna 18 are communicated by the isolator unit 70 to the telvision receiver 12 with a minimum of loss.

In summary, therefore, there has been disclosed a television reception blocking device that incorporates a timer unit to selectively activate and deactivate one or more signal generators to generate a periodic signal of a frequency substantially equal to the carrier frequency of a television broadcast signal to be impeded. This generated signal can then be applied to the television input terminals of a television receiver to interfere with reception of television programming material considered objectionable by a user. It will be noted that no alteration of the television receiver is required in order to use and practice the invention disclosed.

While the above provides the full and complete disclosure of the preferred embodiments of the invention, various modifications, alternate constructions and equivalents may be employed without departing from the true spirit and scope of the invention. For example, rather than use a number of individual oscillator circuits OSC1–OSC12, each being associated with a particular television channel, a voltage controlled oscillator (varactor) could be employed with appropriate circuitry to provide the embodiment of the signal generator circuit. Therefore, the above description and illustrations should not be construed as limiting the scope of the invention which is defined by the appended claims.

What is claimed is:

1. Apparatus for selectively interfering with reception of a radio frequency carrier signal by a receiver during predetermined time periods selectable by a user, each of said time periods commencing at a first predetermined time and terminating at a second predetermined time, the receiver being of the type having antenna input terminals for receiving said radio frequency carrier signal, the apparatus comprising:

means coupled to the antenna input terminals for generating a radio frequency signal substantially equal to the radio frequency carrier signal;

means presettable by the user for selecting and providing preset time information signals indicative of said predetermined time periods; and means coupled to the generating means and responsive to the preset time information signals for activating the generating means at the first predetermined time and for deactivating the generating means at the second predetermined time;

whereby the radio frequency signal provided by the generating means, while the same is activated, causes interference with the reception of the radio frequency carrier signal by the receiver.

2. The apparatus of claim 1, wherein said generating means includes at least one transistorized oscillator.

3. The apparatus of claim 1, the receiver being capable of receiving a plurality of radio frequency carrier signals, and wherein said generating means includes a number of oscillator circuits connected in parallel circuit configuration, each oscillator circuit being structured to generate a radio frequency signal substantially equal to a corresponding one of said plurality of radio frequency carrier signals, said providing means including means presettable by a user for selecting which of said oscillator circuits is to be activated during said predetermined time periods.

4. The apparatus of claim 1, including means for modulating the radio frequency signal.

5. Apparatus for interfering with the reception of a television broadcast signal, having a predetermined carrier frequency, by a televison receiver having antenna input terminals, the apparatus comprising:

timer means for generating an activation signal, the timer means including preset means for causing the activation signal to be initiated at a first presettable time and to terminate at a second presettable time;

signal generator means coupled to the timer means and operable in response to the activation signal for generating an interference signal having a frequency substantially equal to the carrier frequency during the time period defined by the first and second presettable times; and conductor means for coupling the interference signal to the antenna input terminals.

6. The apparatus of claim 5, including means for modulating the interference signal.

7. The apparatus of claim 6, wherein said modulating means includes a 400 Hz oscillator, the interference signal being modulated by a 400 Hz signal.

8. The apparatus of claim 5, the receiver being capable of receiving a plurality of broadcast signals, each having a predetermined carrier frequency different from the others, and wherein said signal generator means includes a number of oscillator circuits connected in parallel circuit configuration, each oscillator circuit corresponding to one of said carrier frequencies, and each oscillator circuit structured to generate a radio frequency signal substantially equal to the corresponding carrier frequency.

9. The apparatus of claim 5, wherein the signal generator means includes a transistorized oscillator circuit for generating the interference signal.

* * * * *